US008602168B2

(12) United States Patent
Tschuppert

(10) Patent No.: US 8,602,168 B2
(45) Date of Patent: Dec. 10, 2013

(54) MOVING MULTIPLE CAGES BETWEEN ELEVATOR SHAFT SIDES

(75) Inventor: Reto Tschuppert, Lucerne (CH)

(73) Assignee: Inventio AG, Hergiswil (CH)

( * ) Notice: Subject to any disclaimer, the term of this patent is extended or adjusted under 35 U.S.C. 154(b) by 376 days.

(21) Appl. No.: 13/023,169

(22) Filed: Feb. 8, 2011

(65) Prior Publication Data

US 2011/0192682 A1 Aug. 11, 2011

(30) Foreign Application Priority Data

Feb. 10, 2010 (EP) ..... 10153164

(51) Int. Cl.
*B66B 9/00* (2006.01)

(52) U.S. Cl.
USPC ..... 187/249; 187/391

(58) Field of Classification Search
USPC ..... 187/247, 249, 250, 289, 391–393, 401, 187/404, 406–408, 409
See application file for complete search history.

(56) References Cited

U.S. PATENT DOCUMENTS 561,223 A 6/1896 Hamilton
5,419,414 A * 5/1995 Sakita ..... 187/391
5,865,274 A * 2/1999 Kiji et al. ..... 187/380
5,877,462 A * 3/1999 Chenais ..... 187/249
6,354,404 B1 3/2002 Sansevero et al.
6,520,295 B1 2/2003 Sansevero et al.
6,854,564 B2 * 2/2005 Reuter et al. ..... 187/249
6,955,245 B2 * 10/2005 Dunser et al. ..... 187/382
7,467,691 B2 * 12/2008 Deplazes et al. ..... 187/249
7,487,860 B2 * 2/2009 Hikita et al. ..... 187/249
7,537,089 B2 * 5/2009 Duenser et al. ..... 187/249
7,621,376 B2 * 11/2009 Duenser et al. ..... 187/249
7,882,934 B2 * 2/2011 Kocher et al. ..... 187/249

FOREIGN PATENT DOCUMENTS

JP 2123086 A 5/1990
JP 04341479 A * 11/1992

OTHER PUBLICATIONS

Translation JP 04341479 A.*

* cited by examiner

*Primary Examiner* — Anthony Salata
(74) *Attorney, Agent, or Firm* — Fraser Clemens Martin & Miller LLC; William J. Clemens

(57) ABSTRACT

An elevator installation has a first cage pair a second cage pair, both movable in an elevator shaft. Cages of a cage pair can move simultaneously in opposite directions within the shaft. In the shaft is a change zone which allows the cages of the cage pair to change between sides of the shaft while in upward or downward motion.

20 Claims, 5 Drawing Sheets

MOVING MULTIPLE CAGES BETWEEN ELEVATOR SHAFT SIDES

CROSS-REFERENCE TO RELATED APPLICATION

This application claims priority to European Patent Application No. 10153164.8, filed Feb. 10, 2010, which is incorporated herein by reference.

FIELD

The disclosure relates to elevator installations with multiple elevator cages and to the operation of such elevator installations.

BACKGROUND

Every elevator installation needs a certain proportion of space in a building depending on the level of traffic. The greater the level of traffic and the higher the building, the more space the elevator installation needs in relation to the usable area of the building.

It is of considerable concern to keep the need for space of an elevator installation as small as possible while the performance or conveying capacity corresponds with the requirements of a building.

There are various approaches to the provision and operation of more than only one elevator cage in an elevator installation, to the arrangement of several parallel elevator shafts of an elevator installation and to the change of shaft of the elevator cages from one elevator shaft to another elevator shaft.

An appropriate example can be inferred from the document JP 04341479 A, Patent Abstracts of Japan, with the title "Double Cage Elevator". According to this Japanese patent application an elevator shaft is proposed in which two elevator cages move in opposite directions. Provided in the middle region of the elevator shaft is a diversion zone which has the form of a widening of the elevator shaft and which is to enable the two elevator cages to pass by each other without colliding.

It is a disadvantage of this previously known elevator installation with an elevator shaft with a diversion zone that the diversion zone occupies a relatively large enclosed area in the building structure. Moreover, the outlay on creating such an elevator shaft with a widening is somewhat unfavorable for structural and engineering reasons.

Elevator installations are also known which are equipped with a so-termed double-deck cage for increasing the conveying capacity. The double-deck cage is an elevator cage with two passenger compartments arranged one above the other. Such a double-deck cage has to be loaded/unloaded simultaneously from two stories when it stops in a boarding zone of the elevator installation. The conveying capacity is thus significantly improved. However, it has proved that a double-deck cage is also accompanied by disadvantages. Thus, such an elevator installation is not capable of flexible use, since the entire double-deck cage always has to be transported even when only a smaller amount of conveying capacity is required. Moreover, the deck spacing of the double-deck cage has to take into consideration the spacing of the stories. The spacing between individual stories is frequently not completely uniform, which obliges additional technical measures with the double-deck cage.

SUMMARY

An increase in conveying capacity can be achieved in that a double shaft is provided instead of only a single elevator shaft and the four elevator cages travel over this double shaft. The elevator cages have a paired layout and execute a change of side in the double shaft in a change zone.

BRIEF DESCRIPTION OF THE DRAWINGS

The technologies are described in detail in the following by way of exemplifying embodiments and with reference to the drawings, in which.

DETAILED DESCRIPTION

Figure 1A:
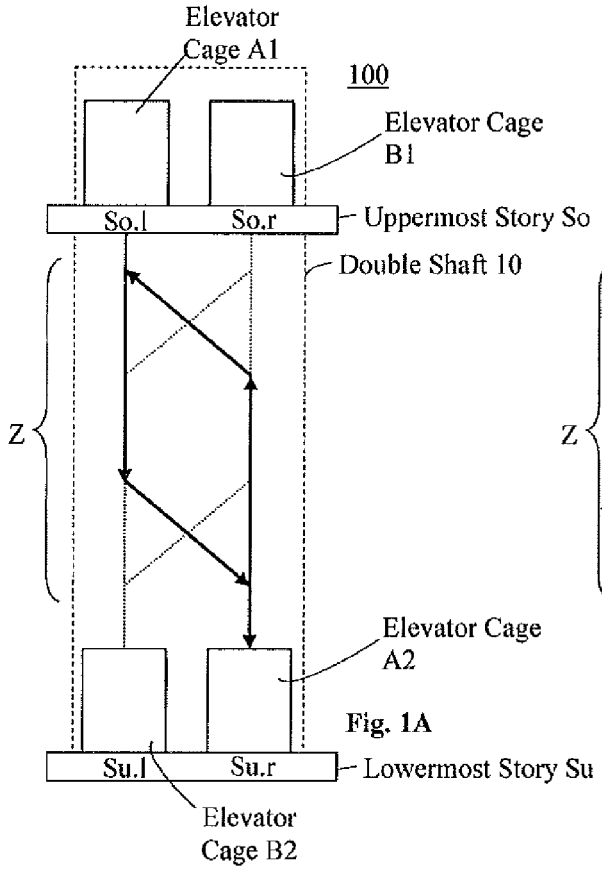
FIG. 1A shows a schematic side view of a first elevator installation at a first instant.

The basic principle of the disclosed technologies is described in connection with FIGS. 1A to 1D.

An elevator installation 100 is installed in a vertical double shaft 10, the interior space of which is illustrated in schematic form in FIGS. 1A to 1D, 4, 5 and 6 by a dotted-line rectangle. The double shaft 10 can be walled in and have two travel paths for the elevator cage or it can be open or partly open and be set up in the form of framework. The double shaft 10 can also be constructed as a shaft per travel path and be open in the change zones.

The elevator installation 100 comprises a first cage pair A with two elevator cages A1, A2 and a second cage pair B with two elevator cages B1, B2, wherein each elevator cage has a travel path and performs a change of travel path in a change zone Z. The change of travel path is termed change of side in the following.

The two elevator cages A1, A2 can, for example, be arranged at the two opposite ends of a first support means (not shown in the figures). The elevator cages A1, A2 can, however, also be guided, without support means, along guide tracks or guide rails 12 (see, for example, FIG. 2 or FIG. 3) arranged at shaft walls of the double shaft 10. In the latter case each of the elevator cages A1, A2 can have its own drive (for example, a linear drive), which is arranged at the elevator cage A1, A2. The guide tracks or guide rails 12 can, however, also have—analogously to a cable car—a traction means which runs in or at the guide tracks or guide rails 12 in order to move the elevator cages A1, A2. In this case the two elevator cages A1, A2 are arranged at the two opposite ends of the traction means (here called first traction means).

The two elevator cages B1, B2 can, for example, be arranged at the two opposite ends of a second support means (not shown in the figures). The elevator cages B1, B2 can, however, also be guided, without traction means, along guide tracks or guide rails 12 (see, for example, FIG. 2 or FIG. 3), which are arranged at shaft walls of the double shaft 10. In the latter case, each of the elevator cages B1, B2 preferably has its own drive (for example a linear drive), which is arranged at the elevator cage B1, B2. The guide tracks or guide rails 12 can, however, also have—analogously to a cable car—a traction means which runs in or at the guide tracks or guide rails 12 in order to move the elevator cages B1, B2. In this case, the two elevator cages B1, B2 are arranged at the two opposite ends of the traction means (here called second traction means).

Drive means, for example in the form of a first, stationary common drive 20 (see FIG. 6), for movement of the two elevator cages A1, A2 of the first cage pair A in opposition are provided. In addition, drive means, for example in the form of a second, stationary common drive 21 (see FIG. 6), for movement of the two elevator cages B1, B2 of the second cage pair B in opposition are provided. If a first and second support means or a first and second traction means are used, stationary drives 20, 21 are provided in the elevator installation 100. In embodiments without support means or traction means, drive means are provided at the elevator cages A1, A2, B1 and B2.

The elevator installation 100 can be so controlled by a control, for example individual controls 22, 23 linked together (see FIG. 6), that either only the first cage pair A or only the second cage pair B is disposed in motion, while the first elevator cage of the respective other elevator pair is located at a lowermost story Su of the elevator installation 100 and the second elevator cage of this elevator pair is located at the uppermost story So of the elevator installation 100.

The (conveying or control) method which is preferably implemented in the individual controls 22, 23 proceeds as follows. The first elevator cage A1 of the first cage pair A is provided at the lowermost story Su of the elevator installation 100 while at the same time the second elevator cage A2 of the first cage pair A is provided at the uppermost story So of the elevator installation 100, as shown in FIG. 1D. Downward conveying of the first elevator cage B1 of the second cage pair B from the uppermost story So to the lowermost story Su now takes place, while at the same time the second elevator cage B2 of the second cage pair B is transported upwardly from the lowermost story Su to the uppermost story So. This process is indicated in FIG. 1D by the arrows P1 and −P1.

The first elevator cage B1 of the second cage pair B executes a change of side SB1 in the double shaft 10 during downward transport −P1 after passing the second elevator cage B2 of the second cage pair B and the second elevator cage B2 of the second cage pair B executes an opposite change of side SB2 in the double shaft 10 during upward transport P1 after passing the first elevator cage B1 of the second cage pair B. The two elevator cages B1 and B2 move vertically past one another in the change zone Z before they execute a crossover change.

The change of side SB1 transfers the first elevator cage B1 from a right-hand shaft region of the elevator shaft 10 to a left-hand shaft region of the elevator shaft 10, i.e. the first elevator cage B1 starts at the uppermost story So on the right-hand side (here denoted by So.r) and lands on the lowermost story Su on the left-hand side (here denoted by Su.1). The second elevator cage B2, in contrast, starts at the lowermost story Su on the left-hand side Su.1 and lands on the uppermost story So on the right-hand side So.r.

In some cases, the two elevator cages A1, A2 of the other cage pair A2 can be at rest while the elevator cages B1, B2 move oppositely to one another. The elevator cages A1, A2 are, depending on the respective form of construction, possibly set in motion only after the elevator cages B1, B2 have reached the upper story So and the lower story Su, respectively. However, it is also possible to release the two elevator cages A1, A2 before the elevator cages B1, B2 have reached the upper story So and the lower story Su, respectively. It is important that the elevator control, for example interlinked individual controls 22, 23 (see FIG. 6), are so designed in every case that there are no collisions in the double shaft 10 in the region of the change zone Z.

In the embodiment schematically shown in FIGS. 1A-1D the change zone Z is so long or the double shaft is so short that release of the respective other elevator cages is not possible while the other two elevator cages run through the change of the side in the change zone Z.

In an actual elevator installation 100 the overall height of a double shaft can be, for example, 80 meters, while the change zone Z can have a height of approximately 10 to 20 meters. In this case the respective other elevator cages can readily embark on the downward or upward travel while the other two elevator cages, for example, perform the change of side.

A situation is shown in FIG. 1 A in which the two elevator cages A1 and B1 are located at the uppermost story So and the elevator cages A1, B2 at the lowermost story Su. While, for example, the elevator cages A1, A2 have only just stopped and now the cage doors and shaft doors (not shown) are opened to allow alighting, the cage and shaft doors (not shown) of the elevator cages B1, B2 can be closed in order to initiate departure.

Figure 1B:
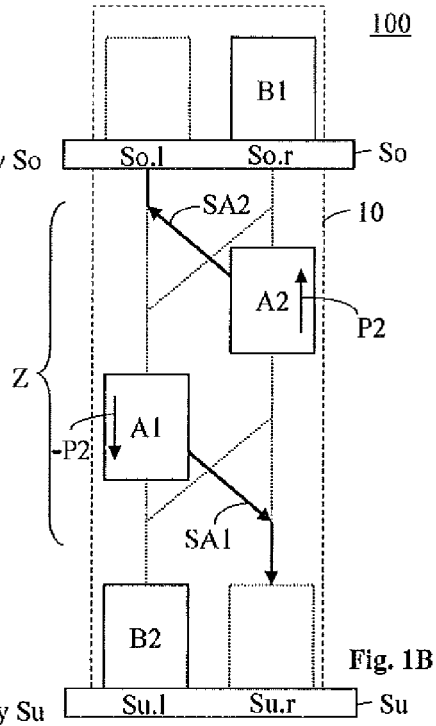
FIG. 1B shows a schematic side view of the first elevator installation at a second instant.

FIG. 1B shows the situation after the elevator cage A1 has embarked on downward travel (arrow −P2) and the elevator cage A2 has embarked on upward travel (arrow P2). The two elevator cages A1, A2 are disposed in the change zone Z shortly before the change SA1 or SA2 to the respective other shaft side (called change of side or crossover change).

Figure 1C:
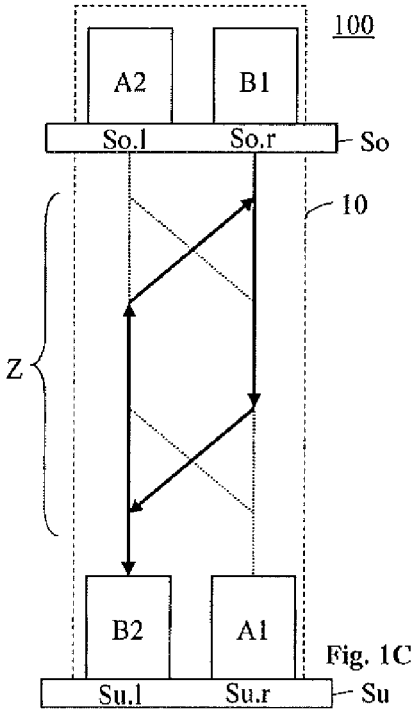
FIG. 1C shows a schematic side view of the first elevator installation at a third instant.
Figure 1D:
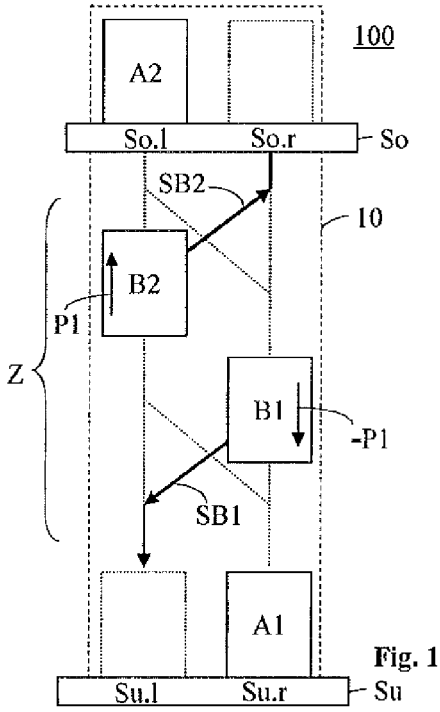
FIG. 1D shows a schematic side view of the first elevator installation at a fourth instant.

A situation is now shown in FIG. 1C in which the two elevator cages A2 and B1 are located at the uppermost story So and the elevator cages A1, B2 at the lowermost story Su.

FIG. 1D shows a situation after the elevator cage B1 has embarked on downward travel (arrow −P1) and the elevator cage B2 embarked on upward travel (arrow P1). The two elevator cages B1, B2 are disposed in the change zone Z shortly before the change SB1 or SB2 to the respective other shaft side.

Shortly after the situation shown in FIG. 1D the elevator cage B2 arrives at the top while the elevator cage B1 arrives at the bottom.

The following symmetrical changes take place, as illustrated by way of a table with actual (exemplifying) statements of time. The pure travel time is here 2 minutes in each case. Added to that is the waiting time which is composed of the duration of the open state of the door and the time elapsing for opening, closing and until departure. A starting time instant is denoted by t0.

| Position | t0 | t0 + 2 min | t0 + 4 min + waiting time | t0 + 6 min + 2 × waiting time |
|---|---|---|---|---|
| Top left (So.1) | A1 | A2 | A2 | A1 |
| Top right (So.r) | B1 | B1 | B2 | B2 |
| Bottom left (Su.1) | B2 | B2 | B1 | B1 |
| Bottom right (Su.r) | A2 | A1 | A1 | A2 |

It can be inferred from the table that the elevator cages A1 and A2 always land at the top left at the position So.1 and at the bottom right at the position Su.r, while the elevator cages B1 and B2 always land at the top right at the position So.r and at the bottom left at the position Su.l.

Figure 2:
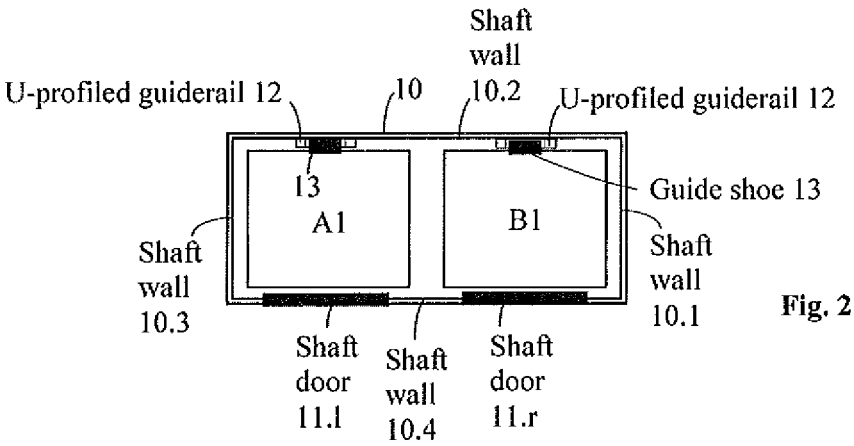
FIG. 2 shows a schematic plan view of a further elevator installation.

FIG. 2 shows a schematic plan view of the two elevator cages A1, B1 at an instant in which they are located at the lowermost story Su. It can be seen from this illustration that two shaft doors 11.1 and 11.*r* are provided at the front shaft wall 10.4 of the double shaft 10 (the cage doors are not shown). The other shaft walls 10.1, 10.2 and 10.3 of the shaft door 10 can in this case be used for the purpose of mounting guide rails or tracks 12 there.

A corresponding U-profiled guide rail 12 is provided here at the (rearward) shaft wall 10.2 for each of the elevator cages A1, A2, B1 and B2. A guide shoe 13 or a guide roller (termed counter-elements) is provided at each elevator cage A1, A2, B1 and B2 at that side which extends parallel to the shaft wall 10.2 of the double shaft 10. A first traction means or support means (not shown), which connects the elevator cages A1, A2 of the first cage pair A together and moves them in opposite directions, can extend in or at the left-hand U-profiled guide rail 12. A second traction means or support means (not shown), which connects the elevator cages B1, B2 of the second cage pair B together and moves them in opposite directions, can extend in or at the right-hand U-profiled guide rail 12. The construction can be designed analogously to a cable car in which an individual stationary drive 20, 21 is provided for each cage pair A and B in or at the double shaft 10 (see, for example, FIG. 6).

According to the embodiment shown in FIG. 2 the guide elements, for example in the form of U-profiled guide rails 12, are arranged at a rearward shaft wall 10.2 of the double shaft 10, whereas the shaft doors 11.1 and 11.*r* are arranged at the opposite front shaft wall 10.4. In addition, the two lateral shaft walls 10.1 and 10.3 can be used for drive means and/or support means, wherein track elements or guide elements enabling the change in side in the double shaft 10 are seated on one of the shaft walls (here, for example, the rearward wall 10.2) over which the two cage pairs A and B travel.

It can be seen by way of FIG. 2 that two shaft doors 11.1 and 11.*r* are provided at the front shaft wall 10.4 of the double shaft 10. The other shaft walls 10.1, 10.2 and 10.3 of the double shaft 10 can in this case be used for mounting guide rails, elements or tracks there.

Figure 3:
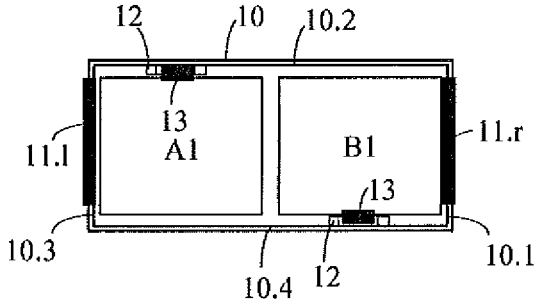
FIG. 3 shows a schematic plan view of a further elevator installation.

FIG. 3 shows a schematic plan view of two elevator cages A1, B1 at a moment in which they are located at the lowermost story Su. In this special form of embodiment the two shaft walls 10.2 and 10.4 are available for guide rails, elements or tracks, since the shaft doors 11.1 and 11.*r* are arranged at the two mutually opposite shaft walls 10.1 and 10.3. The guide rails, elements or tracks of the first cage pair A can be arranged at, for example, the rear wall 10.2 and the guide rails, elements or tracks of the second cage pair B can be arranged at, for example, the front wall 10.4, as indicated in FIG. 3. According to the form of embodiment shown in FIG. 3 a guide element, for example in the form of a U-profiled guide rail 12, is arranged at the rearward wall 10.2 of the double shaft 10.

A guide shoe 13 or a guide roller is provided at each elevator cage of the first cage pair at that side which extends parallel to the rear wall 10.2 of the double shaft 10. According to the form of embodiment shown in FIG. 3 a guide element, for example in the form of a U-profiled guide rail 12, is arranged at the front wall 10.4 of the double shaft 10. A guide shoe 13 or a guide roller is provided at each elevator cage of the second cage pair B at that side which extends parallel to the front wall 10.4 of the double shaft 10.

However, the elevator cages A1, A2, B1 and B2 can also each be provided with a respective individual linear drive. The elevator cages A1, A2, B1 and B2 can be self-moving by virtue of these linear drives. The linear drives move in company with the elevator cages A1, A2, B1 and B2, i.e. they are mobile drives.

A elevator installation with several elevator cages is known from the European patent application, which was published under the number EP 1367018-A2, of the applicant of the present patent application, which cages have at the cage an autonomous linear drive making it possible to independently move the elevator cages in vertical direction in the elevator shafts. The elevator cages are so constructed that a transverse displacement can also be reliably managed. This drive concept can be transferred to the exemplifying embodiments described here.

Teeth analogous to a rack can be provided at the guide rails, elements or tracks 12 in order to be able to provide the necessary mechanically positive couple for an upward or downward travel. In this case the elevator cages A1, A2, B1 and B2 have guide rollers, for example in the form of toothed rollers, which are of complementary construction and which can be driven by the drive at the cage. Such an elevator installation 100 can be constructed without support means.

The drives at the cage can, however, also be designed as magnetic runners which move upwardly or downwardly along stationary metallic or magnetic guide tracks. These magnetic runners generate a strong magnetic attraction force which supports and, in the case of suitable control of the magnetic fields, moves the elevator cages A1, A2, B1 and B2. Such an elevator installation 100 can be constructed without support means. A primary element with several slots and coils is typically arranged at each elevator cage A1, A2, B1 and B2. Disposed in the double shaft 10 for each elevator cage A1, A2, B1 and B2 is a stationary secondary element or an inductor with several permanent magnets arranged with alternating polarity. An air gap is present between the primary element and the secondary element. Details of such an arrangement are known from the European patent application, which was published under the number EP 1168586-A1, of the applicant of the present patent application.

In order to make possible a problem-free change of side of the elevator cages A1, A2, B1 and B2 each of the elevator cages A1, A2, B1 and B2 is, in an embodiment, guided along an individual guide rail, track or element. The corresponding guide rails, tracks or elements can be fastened in stationary position in the double shaft. They can be entirely arranged at a single shaft wall of the double shaft 10 (as indicated in FIG. 2). In an alternative variant of this embodiment the stationary guide rails, elements or tracks of a cage pair A or B are seated on the rear wall 10.2 and the stationary guide rails, elements or tracks of the other cage pair B or A are seated on the front wall 10.4 (as indicated in FIG. 3).

Figure 4:
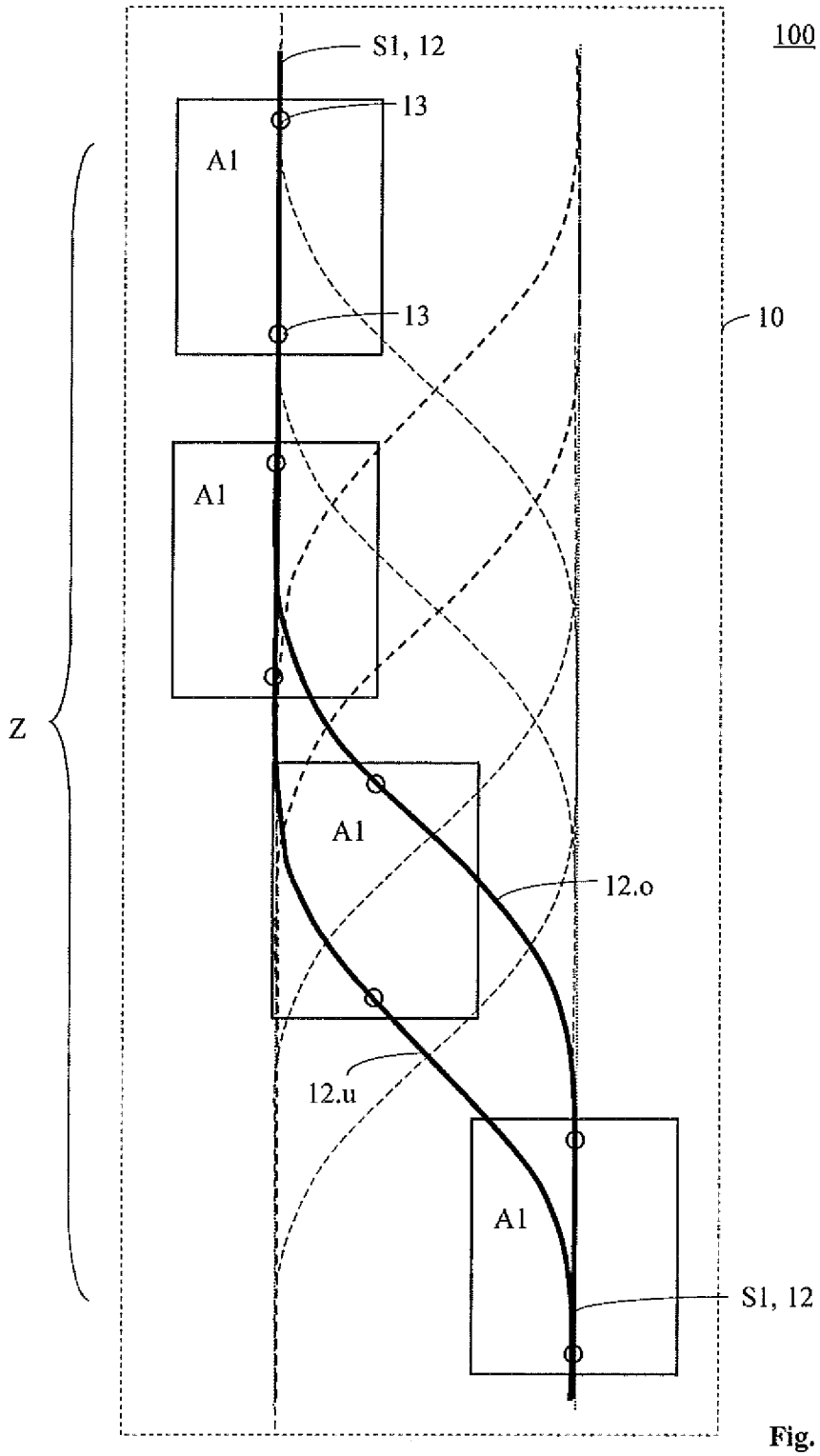
FIG. 4 shows a schematic side view of a detail of a further elevator installation in which an elevator cage A1 is shown in four different positions.

The change zone Z of a double shaft 10 is shown in FIG. 4 in schematic form. An elevator cage A1 moves from above to below along a path S1, which here is illustrated by a thick black line. Guide shoes 13 or guide rollers, which are indicated in FIG. 4 by small circles, are provided at the rear side of the elevator cage A1. In this form of embodiment the upper and the lower guide element 13 slips, slides or rolls in a common guide rail 12 (for example, analogously to FIG. 2) in the case of a vertical travel. The course of the guide rail 12 is represented in FIG. 4 by the path S1. The guide rail 12 branches into an upper and a lower guide rail 12.*o* and 12.*u* in the region of the change zone Z. The upper guide element 13 of the elevator cage A1 moves along the upper guide rail 12.*o*, while the lower guide rail 13 of the elevator cage A1 moves along the lower guide rail 12.*u* when the elevator cage A1 travels through the change zone Z. After traveling through the change zone Z, i.e. after the change of side, the guide elements 13 again slip, slide or roll in a common guide rail 12.

Figure 5:
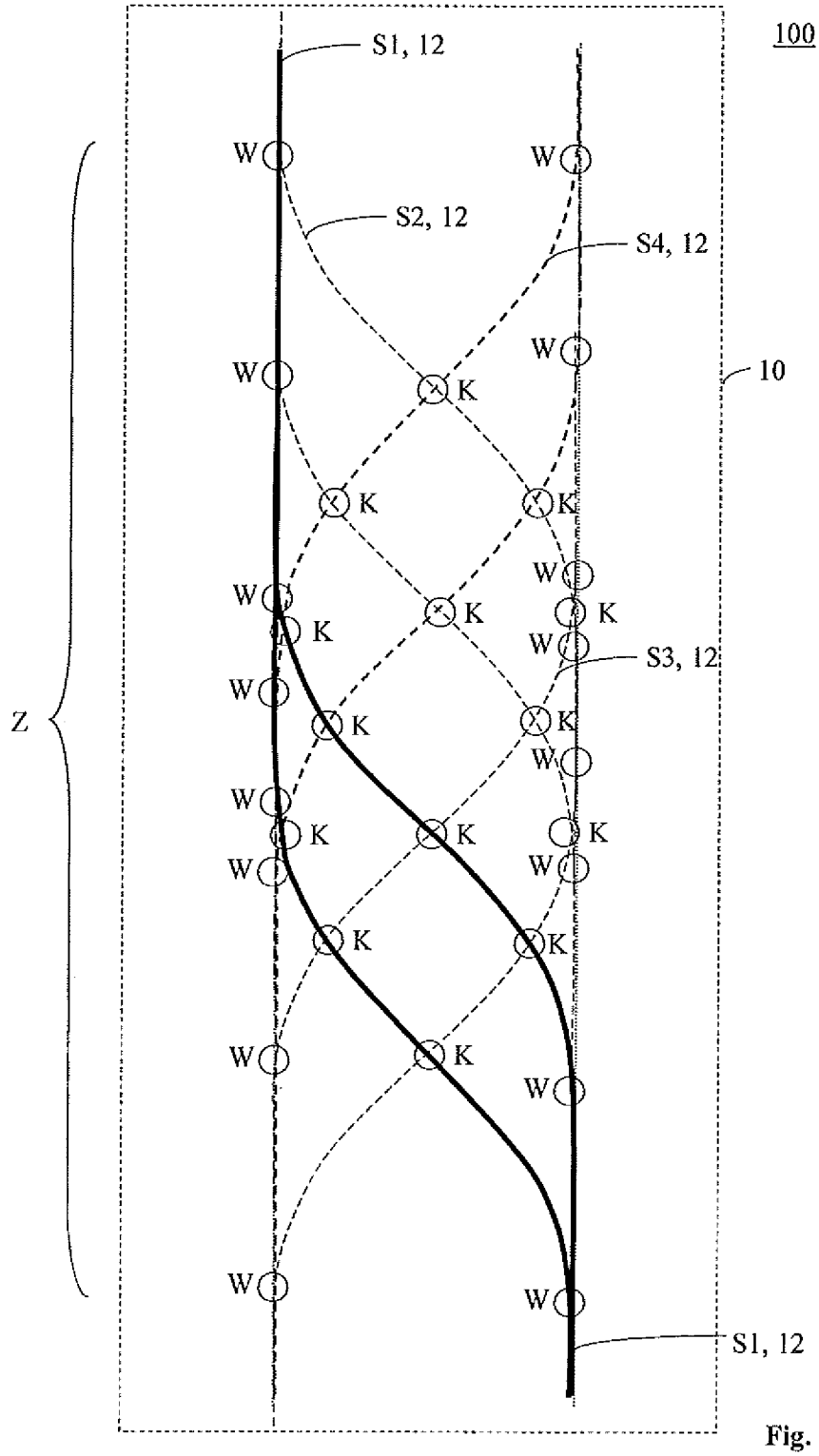
FIG. 5 shows a schematic side view of the elevator installation according to FIG. 4, in which the various tracks are shown.

All other paths are indicated in FIG. 4 and FIG. 5 by dashed lines. S2 is the path of the elevator cage A2, S3 is the path of the elevator cage B1 and S4 is the path of the elevator cage B2.

Arranged at the crossing points K, which arise when all paths are located on a common shaft wall of the double shaft 10 (as is the case in FIGS. 2 and 4), are crossing elements in order to keep the elevator cages A1, A2, B1 and B2 in the respectively correct paths. The positions of the crossing points K with crossing elements are indicated in FIG. 5 by circles. The switching points W allow departure from a path, which is the case shortly before the change zone Z.

Depending on the respective form of embodiment and design of the guide elements, tracks and/or rails, the change of side is executed by a horizontal displacement or by an oblique displacement of the respective elevator cage A1, A2, B1 or B2. Shown in FIGS. 4 and 5 are extensions for oblique displacement, in which the paths are led in curves in order to keep the transverse accelerations acting on passengers in the elevator cages A1, A2, B1 and B2 as small as possible.

Figure 6:
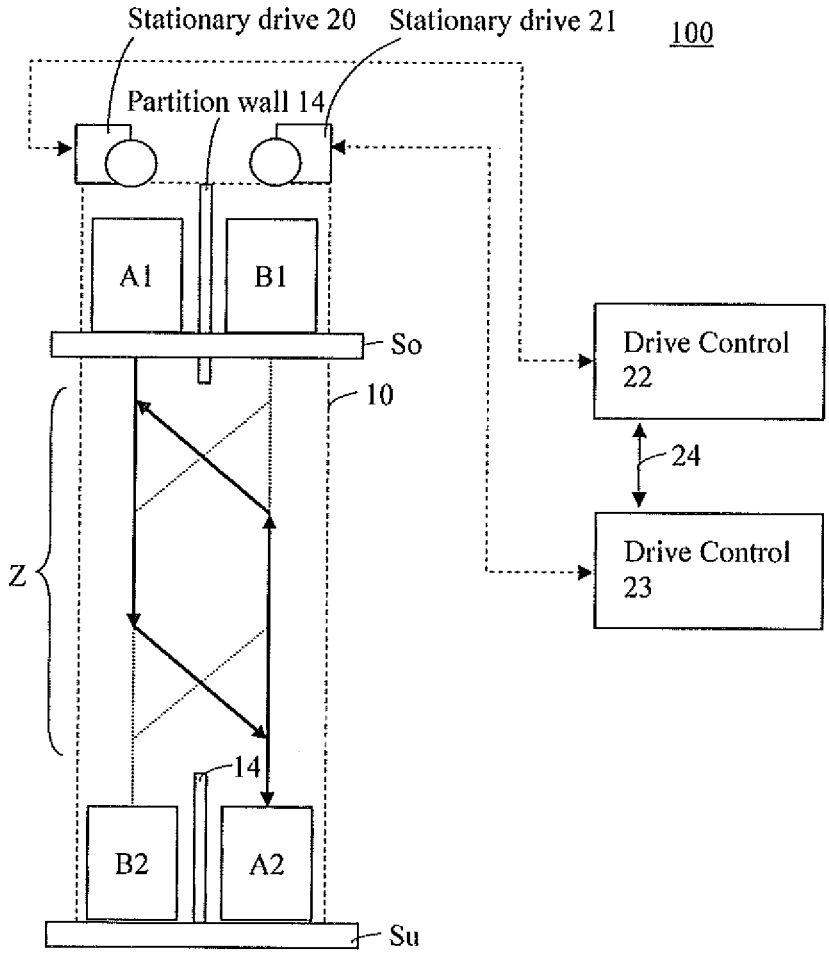
FIG. 6 shows a schematic overall view of a further elevator installation.

Depending on the respective form of embodiment and need the double shaft 10 can be a shaft having a plan area somewhat larger than twice the plan area of an elevator cage A1, A2, B1 or B2. This shaft 10 can have, apart from in the region of the change zone Z, a center partition wall. This center partition wall, however, is optional. Such center partition walls 14 are shown in FIG. 6 in the region of the uppermost story So and the lowermost story Su.

Another embodiment is described in connection with FIG. 6. A first stationary drive 20 is associated with the cage pair A and a second stationary drive 21 with the cage pair B. Each cage pair A and B preferably has an individual drive control 22, 23. These two drive controls 22, 23 are linked together by way of an interface 24 so as to make possible a superordinate co-ordination. It can be ensured by way of this interface 24 that all movements of the elevator cages A1, A2, B1 and B2 proceed in co-ordinated manner. The elevator cages A1, A2, B1 and B2 of each cage pair A, B can be arranged at the respective ends of a support or traction means, as already explained. In this case the support or traction means move the elevator cages A1 and A2 at the same speed oppositely to one another. The same applies to the two elevator cages B1 and B2. Nevertheless, in this case as well the movements of the elevator cages A1, A2, B1 and B2 of the two cage pairs A, B have to be matched to one another, as described in the introduction. Either the drive controls 22, 23 are so co-ordinated that the elevator cages of a cage pair are at rest while the elevator cages of the other cage pair are in motion or time or safety spacings are maintained which predetermine that only after successful performance of a change of side, i.e. only when the two elevator cages of the corresponding cage pair are again disposed in vertical motion, do the other two elevator cages embark on travel.

It can be a significant advantage that counterweights are not employed in any of the forms of embodiment. The respective other elevator cage of a cage pair serves as counterweight. This statement applies only to the forms of embodiment in which both elevator cages of a cage pair are connected with one and the same support means or traction means. In the forms of embodiment which are equipped with an individual drive, for example in the form of a linear drive or magnetic motor, there is also no need for a counterweight. Through the omission of the counterweight it is possible to make better utilization of the cross-sectional on plan area of the double shaft.

The transport performance can be almost doubled by the arrangement of four elevator cages in a double shaft 10.

The illustrated exemplifying embodiments can be particularly suitable for elevator installations of medium height and great height. Use can be particularly preferred in situations in which there are only a lowermost and an uppermost stop, as is the case, for example, in viewing towers and viewing platforms of skyscrapers.

An optimal utilization can be achieved if the time needed for loading and unloading of the elevator cages approximately corresponds with the journey time from the lowermost story Su to the uppermost story So.

Further exemplifying characteristics of the disclosed technologies are stated in the following. Depending on the respective drive control, the technologies make possible the maintenance of a high transport capacity in the case of an emergency or in maintenance situations when, for example, a cage pair completely fails or is blocked. The technologies also make possible an efficient increase in transport capacity in comparison with conventional installations with two elevator shafts and a respective elevator cage per shaft.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator operation method, comprising:

in an elevator shaft in which are disposed first and second elevator cage pairs, moving a first elevator cage of the first elevator cage pair downwardly along a first vertical side in the elevator shaft while moving a second elevator cage of the first elevator cage pair upwardly along a second vertical side in the elevator shaft, the first and second vertical sides including a change zone intermediate upper and lower ends of the first and second vertical sides; and while the first elevator cage of the first elevator cage pair is moving downwardly and the second elevator cage of the first elevator cage pair is moving upwardly, and after the first elevator cage of the first cage pair at least partially passes the second elevator cage of the first elevator cage pair in the change zone, moving the first elevator cage of the first cage pair from the first vertical side of the elevator shaft to the second vertical side of the elevator shaft and moving the second elevator cage of the first elevator cage pair from the second vertical side of the elevator shaft to the first vertical side of the elevator shaft.

2. The elevator operation method of claim 1, further comprising:

moving a first elevator cage of the second elevator cage pair downwardly along the second vertical side in the elevator shaft while moving a second elevator cage of the second elevator cage pair upwardly along the first vertical side in the elevator shaft; and while the first elevator cage of the second elevator cage pair is moving downwardly and the second elevator cage of the second elevator cage pair is moving upwardly, and after the first elevator cage of the second elevator cage pair at least partially passes the second elevator cage of the second cage pair in the change zone, moving the first elevator cage of the second elevator cage pair from the second vertical side of the elevator shaft to the first vertical side of the elevator shaft and moving the second elevator cage of the second cage pair from the first vertical side of the elevator shaft to the second vertical side of the elevator shaft.

3. The elevator operation method of claim 1, wherein the first and second elevator cages of the first cage pair are guided by respective guide elements.

4. The elevator operation method of claim 1, wherein at least one of the first and second elevator cages of the first cage pair is driven by at least one stationary drive.

5. The elevator operation method of claim 1, wherein the first elevator cage of the first elevator cage pair serves as counterweight for the second elevator cage of the first elevator cage pair.

6. The elevator operation method of claim 1, wherein the first and second elevator cages of the first and second elevator cage pairs are configured to move between an uppermost story of the elevator installation and a lowermost story of the elevator installation.

7. The elevator operation method of claim 1, wherein the at least one of the first and second elevator cages of the first cage pair is driven by at least one mobile drive.

8. An elevator installation comprising:

a first pair of elevator cages disposed in a shaft, the shaft comprising first and second sides and a change zone, the change zone being positioned between upper and lower floors served by the elevator installation ; and a second pair of elevator cages disposed in the shaft, wherein the first elevator cage of the first pair is configured to move downward along the first side while the second elevator cage of the first pair moves upward along the second side, the first and second elevator cages of the first pair being configured to move between the first and second sides of the shaft in the change zone.

9. The elevator installation of claim 8, wherein the first elevator cage of the second pair is configured to move downward along the second side while the second elevator cage of the second pair moves upward along the first side, the first and second elevator cages of the second pair being configured to move between the first and second sides of the shaft in the change zone.

10. The elevator installation of claim 8, further comprising a first drive means for moving the first pair of elevator cages and a second drive means for moving the second pair of elevator cages.

11. The elevator installation of claim 8, further comprising one or more guide elements disposed in the shaft and configured to couple to one or more elevator cages.

12. The elevator installation of claim 11, wherein the one or more guide elements comprise at least one magnetic guide track.

13. The elevator installation of claim 11, wherein the one or more guide elements comprise at least one rack.

14. The elevator installation of claim 11, wherein the one or more guide elements comprise a U-profiled rail.

15. The elevator installation of claim 11, wherein the one or more guide elements comprise a plurality of crossing points and a plurality of switching points.

16. The elevator installation of claim 8, further comprising at least one drive control coupled to the first pair or second pair of elevator cages.

17. An elevator control system comprising:

a first elevator drive control; and a second elevator drive control, wherein the first elevator drive control is configured to instruct a first elevator drive in an elevator installation and the second elevator drive control is configured to instruct a second elevator drive in the elevator installation, wherein the first and second elevator drive controls are further configured to coordinate the movement of two pairs of elevator cages within an elevator shaft, the movement within the elevator shaft comprising upward movement, downward movement and movement between left and right sides of the elevator shaft in a chance zone positioned between upper and lower floors served by the elevator cages.

18. The elevator control system of claim 17, further comprising an interface between the first elevator drive control and the second elevator drive control.

19. The elevator control system of claim 17, wherein the first elevator drive comprises a stationary drive.

20. The elevator control system of claim 17, wherein the first elevator drive comprises a mobile drive.

* * * * *